United States Patent [19]

Jäggle et al.

[11] 4,201,172

[45] May 6, 1980

[54] FUEL INJECTION NOZZLE ASSEMBLY FOR INTERNAL COMBUSTION ENGINES

[75] Inventors: Günther Jäggle, Stuttgart; Herbert Scharl, Ditzinger; Rudolf Krauss, Stuttgart, all of Fed. Rep. of Germany

[73] Assignee: Robert Bosch GmbH, Stuttgart, Fed. Rep. of Germany

[21] Appl. No.: 694,288

[22] Filed: Jun. 9, 1976

Related U.S. Application Data

[60] Division of Ser. No. 546,671, Feb. 3, 1975, abandoned, which is a continuation of Ser. No. 365,631, May 31, 1973, abandoned.

[30] Foreign Application Priority Data

Jul. 10, 1972 [DE] Fed. Rep. of Germany ..... 2233919

[51] Int. Cl.[2] ..... F02M 61/14

[52] U.S. Cl. ..... 123/139 AW; 239/600; 403/372

[58] Field of Search ..... 123/139 AW; 239/600, 239/584, 533.2; 403/243, 372

[56] References Cited

U.S. PATENT DOCUMENTS

| | | | |
|---|---|---|---|
| 3,198,441 | 8/1965 | Facius | 239/550 |
| 3,628,816 | 12/1971 | Ross, Jr. | 403/243 X |
| 3,776,209 | 12/1973 | Wertheimer et al. | 123/139 AW X |
| 3,941,109 | 3/1976 | Schmid | 123/139 AW |

FOREIGN PATENT DOCUMENTS

| | | | |
|---|---|---|---|
| 1174487 | 3/1959 | France | 403/243 |

*Primary Examiner*—Tony M. Argenbright
*Attorney, Agent, or Firm*—Edwin E. Greigg

[57] ABSTRACT

A fuel injection nozzle assembly for use in an externally ignited internal combustion engine of the air/fuel mixture-compressing type and with fuel injection into a tube through which air is suctioned into the engine, comprising a fuel injection nozzle and heat-insulating means surrounding a part of the nozzle is described. The heat-insulating means surround especially the nozzle part to be inserted into a bore in the wall of the air intake tube. Preferably, the heat-insulating means is a sleeve member made of heat-insulating rubber. The assembly is such that the fuel injection nozzle can be readily removed from the air intake tube. Moreover, both the fuel injection nozzle and the sleeve member can be assembled as a unit.

7 Claims, 1 Drawing Figure

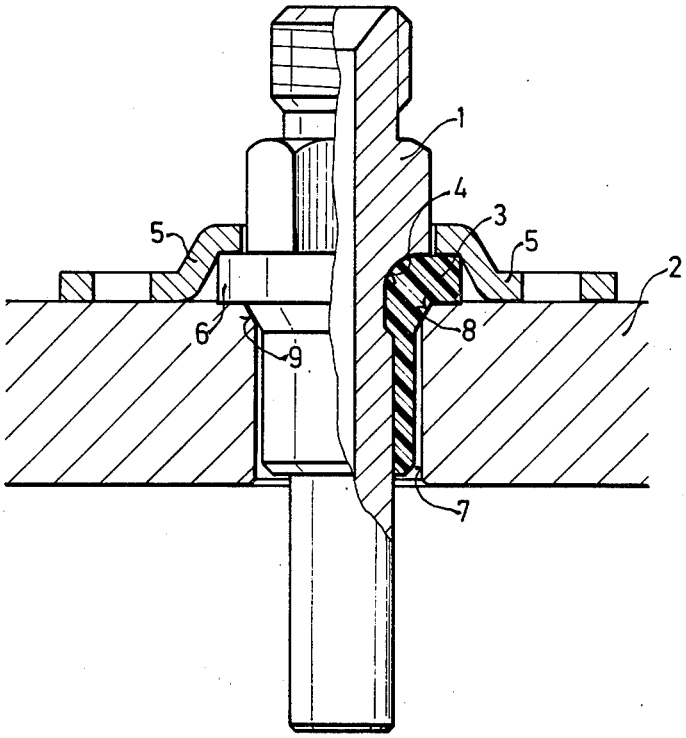
1
4
3
5
5
2
6
9
8
7

FUEL INJECTION NOZZLE ASSEMBLY FOR INTERNAL COMBUSTION ENGINES

CROSS-REFERENCE TO RELATED APPLICATIONS

This is a divisional application of application Ser. No. 546,671, filed Feb. 3, 1975, which in turn is a continuation application of application Ser. No. 365,631, filed May 31, 1973, both now abandoned.

BACKGROUND OF THE INVENTION

This invention relates to a fuel injection nozzle assembly for use in externally ignited internal combustion engines of the air-fuel mixture-compressing type being provided with fuel injection into a suction tube of the engine.

The fuel injection valves built into the suction tube, which serves for the intake of air, or, the engine block are heated up strongly, especially after stopping the engine, by the heat extending from the hot engine block and the exhaust pipes. The temperature to which the fuel injection nozzle is thus brought corresponds to a vapor pressure of 4 and 5 bar depending on the kind of fuel used. Because of technical requirements in controlling the amount of fuel, the opening pressure of the fuel injection valves must not surpass a determined pressure, for example 3.5 bar; in consequence whereof fuel vaporizes into the nozzle ducts. The share of fuel thus lost must be replaced when restarting the still luke-warm or cooled-down engine. This results in considerable starting time-lags, or the engine must be restarted several times and does not idle smoothly due to failure of the nozzle to spray the fuel, or to irregular spray of fuel from the nozzle.

OBJECTS AND SUMMARY OF THE INVENTION

A main object of the invention is to provide an improved fuel injection nozzle assembly comprising a fuel injection valve which adopts the temperature of the flowing fuel during driving, notwithstanding high engine temperatures, and which delays the warm up of the fuel injection valve when the engine is shut off, until the engine has cooled off.

A further object of the invention resides in the provision of a mounting for the fuel injection nozzle such that the nozzle is readily removable from the mounting, and such that the nozzle and holder can be assembled as a unit.

These and other objects are achieved in accordance with the invention by providing a fuel injection nozzle assembly comprising heat-insulating means between the fuel injection nozzle and the wall of the suction tube by means of a substance having a low thermal conductivity, a heat-insulating sleeve of such material being advantageously arranged between a nozzle holder and a bore in the suction tube in which the nozzle is inserted.

In a preferred embodiment of the invention, the said sleeve is provided with annular beads and/or projections engaging corresponding annular grooves and/or cavities in the nozzle holder whereby a positive connection of the sleeve with the nozzle holder is effected.

The invention will be better understood and further objects and advantages will become apparent from the ensuing detailed specification of a preferred but merely exemplary embodiment taken in conjunction with the drawing.

BRIEF DESCRIPTION OF THE DRAWING

The sole FIGURE shows a fuel injection nozzle mounting in a suction tube according to a preferred embodiment of the invention.

DESCRIPTION OF THE PREFERRED EMBODIMENT

An injection nozzle 1 is mounted with an elongated portion in a radial bore 7 through the wall of suction tube 2 (only a portion of which is shown). A sleeve member 3 of heat-insulating material, for instance heat-resistent rubber, is interposed between the injection nozzle 1 and the wall of the suction tube 2 so as to prevent metallic contact of the injection nozzle with the suction tube.

As shown, an annular groove 4 is provided about the mantle surface of nozzle 1 which groove 4 is positively engaged by the sleeve member 3, whereby the injection nozzle can be clamped onto the suction tube 2 by means of straps 5 and a collar 6. The bore 7 has an annular bevelled face 8, on to which a frustoconical portion 9 of sleeve member 3 is pressed when the latter is fastened in bore 7; on one hand this seals off the interior of the suction tube from the outside, and on the other hand fills in the clearance resulting between sleeve member 3 and bore 7.

Thanks to the heat-insulation provided by the material of sleeve member 3, the temperature of injection nozzle 1 remains at all times below 90° to 100° C., whereby the flow pressure in the suction tube 2 is maintained higher than the vapor pressure of the fuel.

With the arrangement shown, it is easy to see that the injection nozzle 1 and the sleeve member 3 can be either assembled as a unit and thereafter mounted within the bore 7 and retained therein by the strap 5, or the sleeve member 3 can be mounted within the bore 7 and retained therein by the strap 5 and thereafter the injection nozzle "snapped" into the position shown. In either case, the installation is simplified and accordingly represents a cost saving in manufacture.

The sleeve member 3 is also provided with a bevelled face 10 and the injection nozzle 1 with a corresponding bevelled face which engages the face 10 in assembly. With this arrangement, the ready removability of the injection nozzle 1 from the mounting can be seen. This feature is quite desirable for the advantage derived in being able to easily and quickly replace a defective nozzle.

What is claimed is:

1. A fuel injection nozzle assembly for use in an externally ignited internal combustion engine, comprising:

(a) a fuel injection nozzle having an elongated body portion in the outer surface of which there is formed a recess;

(b) a flanged sleeve having a surface defining a bore into which the nozzle body is received, said surface including a protrusion which is received within said recess in a form-fitting manner for retaining the nozzle in engagement with the sleeve; and (c) fastening means engageable with the flange of said sleeve for mounting the sleeve and nozzle to the engine.

2. The fuel injection nozzle assembly as defined in claim 1, wherein the recess and protrusion have an annular extent.

3. The fuel injection nozzle assembly as defined in claim 1, wherein the engaging surfaces of the recess and protrusion are such that the nozzle is readily removable from the sleeve.

4. A fuel injection nozzle-and-suction tube assembly for use in an externally ignited internal combustion engine of the air/fuel mixture-compressing type with fuel injection into an air intake duct of the engine, comprising, in combination:

(a) a suction tube having a radial bore through the wall thereof, the rim of said bore at the outside of said tube being chamfered;

(b) an injection nozzle having a portion thereof inserted into said bore;

(c) a sleeve member interposed between the outer surface of said inserted nozzle portion and the inner wall of said bore for sealing off said bore and supporting said injection nozzle within said bore, the sleeve member being provided with a frusto-conical face whose angle with the sleeve axis corresponds to that of said chamfered rim relative to the axis of said bore; and (d) means for pressing said frusto-conical face of said sleeve member sealingly against said chamfered rim.

5. A fuel injection nozzle and mounting sleeve therefor in which the nozzle includes an elongated body portion in the outer surface of which there is formed a recess and the mounting sleeve includes a surface defining a bore into which the nozzle body is received, said surface having a protrusion which is received within said recess in a form-fitting manner for retaining the nozzle in engagement with the mounting sleeve.

6. The fuel injection nozzle and mounting sleeve as defined in claim 5, wherein the recess and protrusion have an annular extent.

7. The fuel injection nozzle and mounting sleeve as defined in claim 5, wherein the engaging surface of the recess and protrusion are such that the nozzle is readily removable from the mounting sleeve.

* * * * *